US010644425B2

(12) United States Patent
Hashimoto et al.

(10) Patent No.: US 10,644,425 B2
(45) Date of Patent: May 5, 2020

(54) CONNECTOR

(71) Applicant: Sumitomo Wiring Systems, Ltd., Yokkaichi, Mie (JP)

(72) Inventors: Norihito Hashimoto, Mie (JP); Wataru Yamanaka, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/258,983

(22) Filed: Jan. 28, 2019

(65) Prior Publication Data

US 2019/0237892 A1 Aug. 1, 2019

(30) Foreign Application Priority Data

Jan. 29, 2018 (JP) ..... 2018-012542

(51) Int. Cl.

| | |
|---|---|
| ***H01R 13/11*** | (2006.01) |
| ***H01R 13/64*** | (2006.01) |
| ***H01R 13/42*** | (2006.01) |
| ***H01R 4/18*** | (2006.01) |
| ***H01R 13/422*** | (2006.01) |
| *H01R 13/52* | (2006.01) |
| *H01R 107/00* | (2006.01) |

(52) U.S. Cl.

CPC ..... *H01R 13/113* (2013.01); *H01R 4/18* (2013.01); *H01R 13/42* (2013.01); *H01R 13/4223* (2013.01); *H01R 13/64* (2013.01); *H01R 4/185* (2013.01); *H01R 13/5205* (2013.01); *H01R 13/5219* (2013.01); *H01R 2107/00* (2013.01)

(58) Field of Classification Search

CPC ..... H01R 13/113; H01R 13/42; H01R 13/64; H01R 13/5205; H01R 4/18

See application file for complete search history.

(56) References Cited

U.S. PATENT DOCUMENTS

| | | | | |
|---|---|---|---|---|
| 6,585,544 | B2 * | 7/2003 | Furutani | H01R 13/113 439/252 |
| 7,001,206 | B2 * | 2/2006 | Sakurai | H01R 13/4362 439/489 |
| 9,407,025 | B2 * | 8/2016 | Hashimoto | H01R 13/432 |
| 9,509,078 | B2 * | 11/2016 | Hashimoto | H01R 13/055 |
| 9,570,854 | B2 * | 2/2017 | Hashimoto | H01R 13/113 |
| 2017/0170589 | A1 * | 6/2017 | Kida | H01R 4/18 |

FOREIGN PATENT DOCUMENTS

JP 2016-062807 4/2016

* cited by examiner

*Primary Examiner* — Abdullah A Riyami
*Assistant Examiner* — Nader J Alhawamdeh
(74) *Attorney, Agent, or Firm* — Gerald E. Hespos; Michael J. Porco; Matthew T. Hespos

(57) ABSTRACT

A connector includes a housing (10) formed with a terminal accommodation chamber (13) and a terminal fitting (30) to be inserted into the terminal accommodation chamber (13) from behind the housing (10). A stabilizer (35) projects from an outer peripheral surface of the terminal fitting (30), and an interfering portion (19) is formed on an inner wall of the terminal accommodation chamber (13). The terminal fitting (30) contacts the interfering portion (19) when the terminal fitting (30) is inserted into the terminal accommodation chamber (13) in an improper posture, and this contact presses the terminal fitting 30 in a direction intersecting a projecting direction of the stabilizer (35).

9 Claims, 9 Drawing Sheets

CONNECTOR

BACKGROUND

Field of the Invention

The invention relates to a connector.

Related Art

Japanese Unexamined Patent Publication No. 2016-062807 discloses a terminal fitting formed with a plate-like stabilizer projecting on an outer periphery. This terminal fitting is inserted into a terminal accommodation chamber formed in a connector housing. A guide groove for accommodating the stabilizer when the terminal fitting is inserted in a proper posture is formed in the terminal accommodation chamber. The stabilizer interferes with an opening edge of the terminal accommodation chamber if the terminal fitting is attempted to be inserted into the terminal accommodation chamber in a vertically or laterally inverted improper posture. Thus, the insertion of the terminal fitting is restricted. Specifically, the stabilizer has a function of detecting whether or not the inserting posture of the terminal fitting into the terminal accommodation chamber is proper.

Some known terminal fittings have a stabilizer formed by striking an outer peripheral wall of a terminal fitting. However, a stabilizer formed by striking has a relatively small projecting dimension. Thus, if a clearance between the outer peripheral surface of the terminal fitting and the inner wall surface of a terminal accommodation chamber is large, the stabilizer does not interfere with an opening edge of the terminal accommodation chamber and the terminal fitting may be inserted into the terminal accommodation chamber in an improper posture.

The invention aims to prevent a terminal fitting from being inserted into a terminal accommodation chamber in an improper posture.

SUMMARY

The invention is directed to a connector with a housing formed with a terminal accommodation chamber, and a terminal fitting is inserted into the terminal accommodation chamber from behind the housing. A stabilizer projects from an outer peripheral surface of the terminal fitting, and an interfering portion is formed on an inner wall part of the terminal accommodation chamber. The stabilizer contacts the interfering portion when the terminal fitting is inserted into the terminal accommodation chamber in an improper posture and presses the terminal fitting in a direction intersecting a projecting direction of the stabilizer.

According to this configuration, the terminal fitting is displaced by the interference of the stabilizer and the interfering portion when the terminal fitting is inserted into the terminal accommodation chamber in an improper posture. Thus, a degree of interference of the terminal fitting with the housing increases. In this way, the terminal fitting is prevented from being inserted into the terminal accommodation chamber in the improper posture.

The stabilizer may be disposed at a position near a front end of the terminal fitting. According to this configuration, whether the terminal fitting is in an improper posture can be detected early in the process of inserting the terminal fitting.

The terminal fitting of one embodiment is formed with a rectangular tubular terminal body at a front part of the terminal fitting. A coupling is formed in a rear part of the terminal fitting of this embodiment and is configured to be crimped to a wire. The coupling is wider than the terminal body. An escaping recess for avoiding interference with the coupling is formed in the inner wall of the terminal accommodation chamber, and the interfering portion is formed in the escaping recess. According to this configuration, the shape of the inner wall of the terminal accommodation chamber can be simplified as compared to the case where the interfering portion is formed in a part different from the escaping recess.

DETAILED DESCRIPTION

Figure 1:
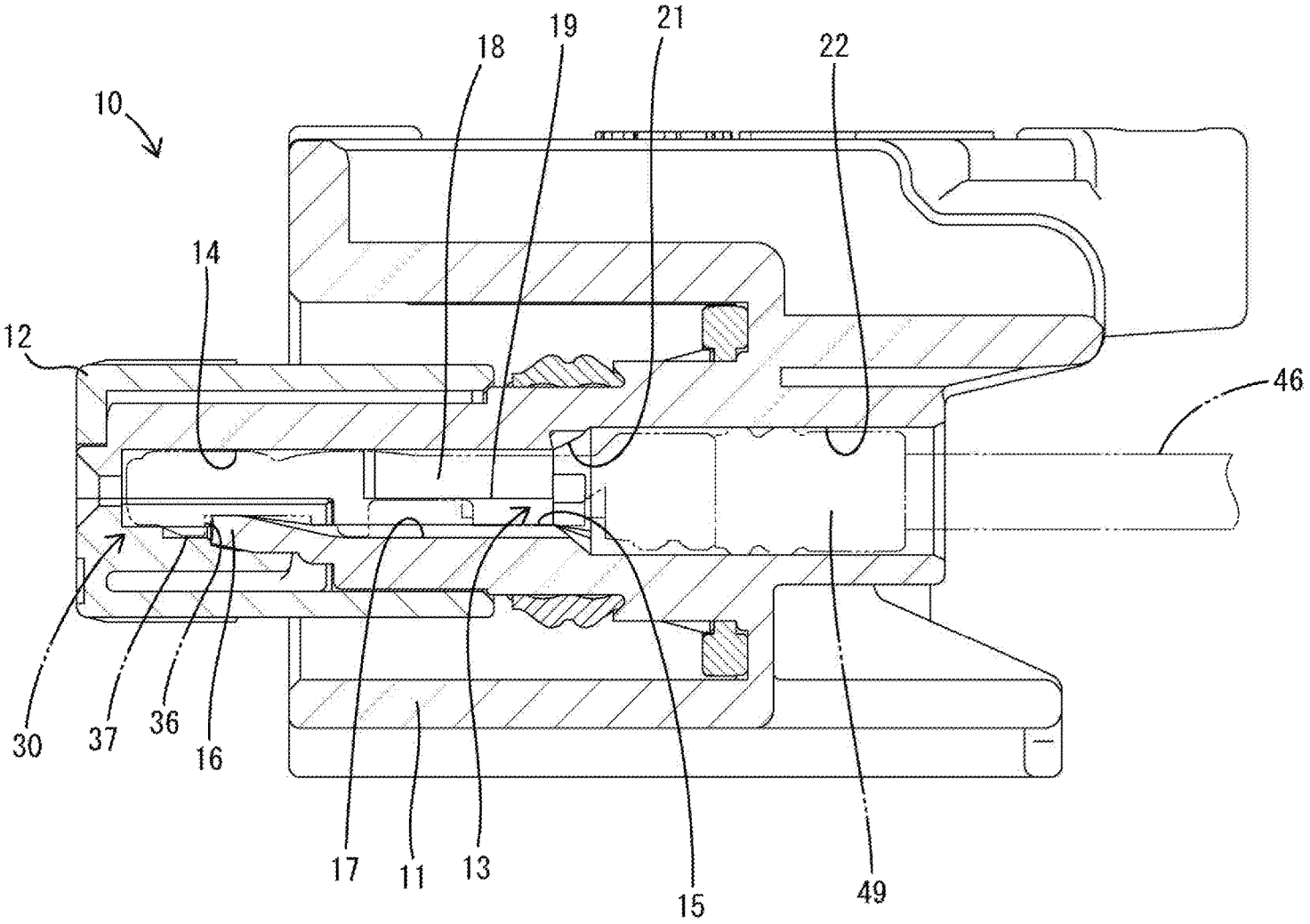
FIG. 1 is a side view in section of a connector of one embodiment.
Figure 2:
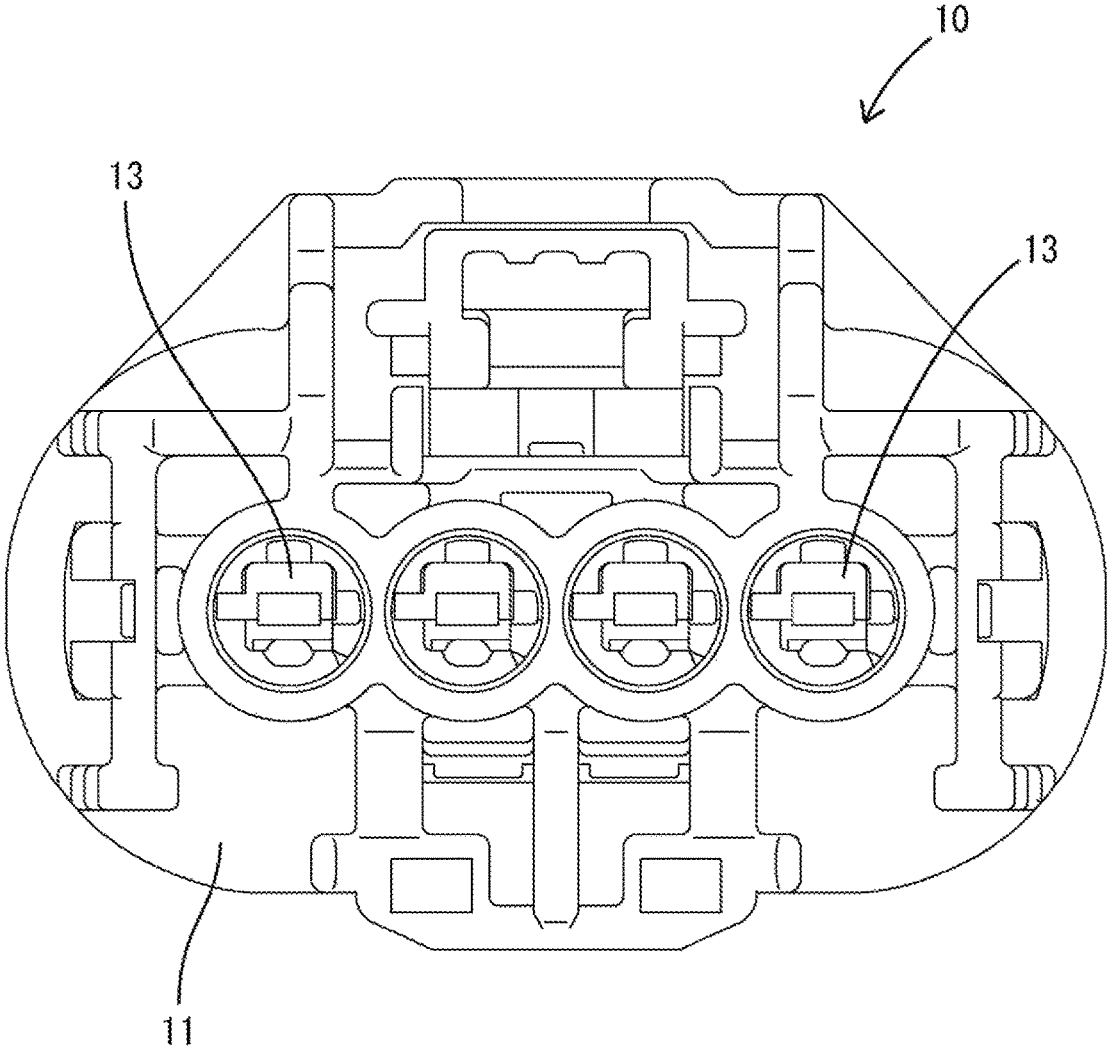
FIG. 2 is a back view of a housing.
Figure 3:
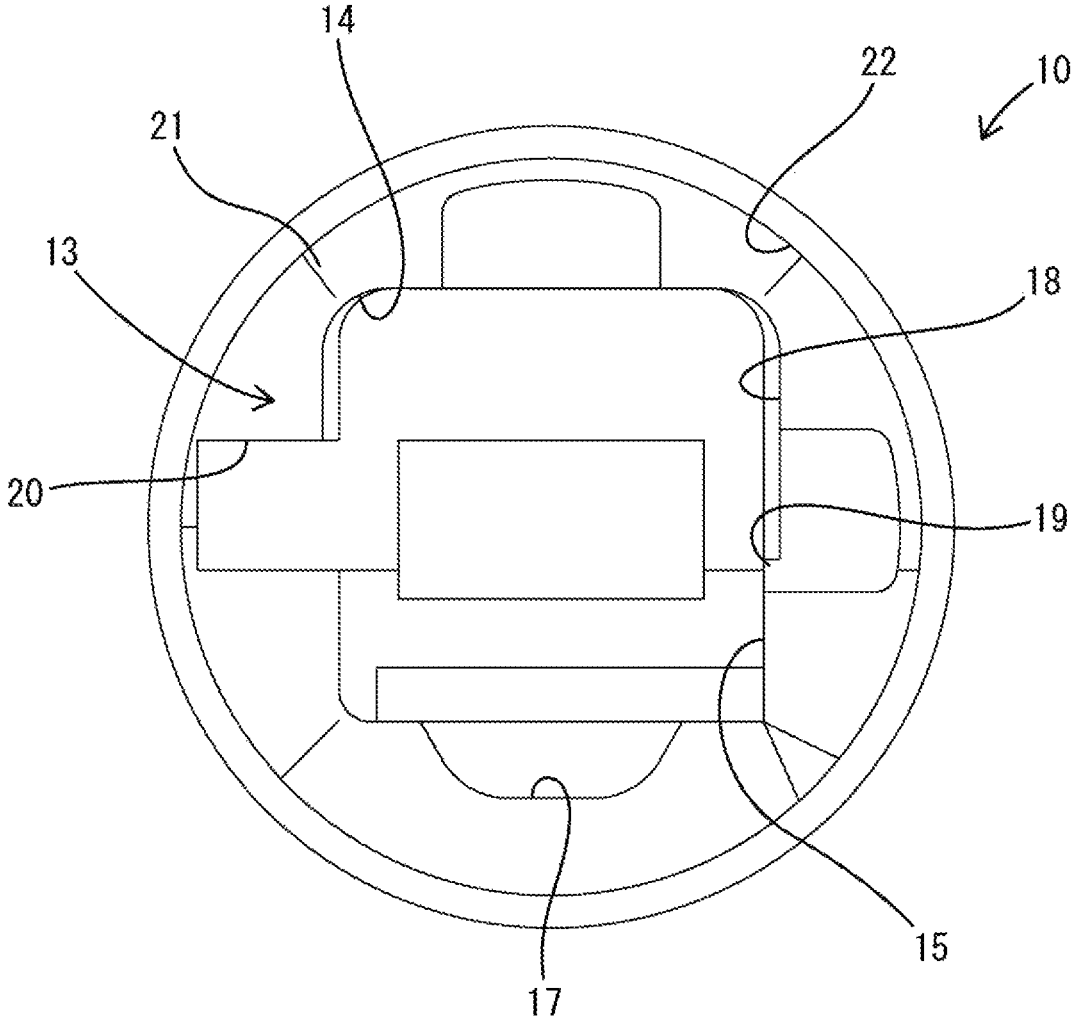
FIG. 3 is a back view enlargedly showing a terminal accommodation chamber.

An embodiment of the invention is described with reference to FIGS. 1 to 9. In the following description, a left side in FIG. 1 is defined as a front concerning a front-rear direction. Upper and lower sides shown in FIGS. 1 to 6 are defined as upper and lower sides concerning a vertical direction. Left and right sides shown in FIGS. 2 to 6 are defined as left and right sides concerning a lateral direction.

<Connector>

A connector of this embodiment includes the housing 10 and terminal fittings 30 and are mounted into the housing 10 from behind. The connector has a waterproof function and a function of detecting an improper posture when the terminal fitting 30 is going to be mounted into the housing 10 in a vertically inverted improper posture.

<Housing 10>

The housing 10 includes a housing body 11 made of synthetic resin and a front member 12 made of synthetic resin and mounted in a front part of the housing body 11. Long narrow terminal accommodation chambers 13 long and narrow in the front-rear penetrate the housing 10 from the front end to the rear end of the housing 10. As shown in FIG. 1, the terminal accommodation chamber 13 is composed of a holding space 14, a guiding space 21 and a sealing space 22.

The holding space 14 constitutes a front part of the terminal accommodation chamber 13 and is long and narrow in the front-rear direction. The holding space 14 has a substantially rectangular cross-section taken along a plane perpendicular to the front-rear direction. The front end of the holding space 14 is open at the front surface of the housing 10 and the rear end forms a terminal entrance opening 15.

As shown in FIG. 1, a locking lance 16 is cantilevered forward along a lower surface of the holding space 14 and at a position near the front end of the holding space 14. A guide groove 17 is formed in the lower surface of the holding space 14 and extends in the front-rear direction (direction parallel to the inserting direction of the terminal fitting 30 into the terminal accommodation chamber 13). The guide groove 17 is continuously formed in an area from the rear end (terminal entrance opening 15) of the holding space 14 to the locking lance 16.

A shallow escaping recess 18 is formed in a right surface at a rear end area of the holding space 14 (area behind a center of the holding space 14 in the front-rear direction). A formation area of the escaping recess 18 in the vertical direction is an upper end area of the right surface. In particular, this formation area is a range from a position slightly below a vertical center of the right surface to the upper end of the right surface. The escaping recess 18 has a rectangular shape long in the front-rear direction in a side view. The rear end of the escaping recess 18 is open to the terminal entrance opening 15 on the rear end of the holding space 14.

As shown in FIGS. 3 to 6, an area of the right surface along the lower end edge of the escaping recess 18 serves as an interfering portion 19 with a stepped back view shape. A width of a substantially rear half area of the holding space 14 is larger in an area where the escaping recess 18 is formed (area above the interfering portion 19) than in an area where the escaping recess 18 is not formed (area below the interfering portion 19). Left and right side plates 42 constituting a coupling 40 of the terminal fitting 30 to be described later is accommodated into the escaping recess 18.

A positioning groove 20 extends in the front-rear direction in a left surface (side surface on a side opposite to the right surface in the lateral direction perpendicular to the inserting direction of the terminal fitting 30 into the terminal accommodation chamber 13) of the holding space 14. The positioning groove 20 is formed continuously from the front end to the rear end of the holding space 14. A stabilizer 35 of the terminal fitting 30 is accommodated into the positioning groove 20.

The guiding space 21 is disposed behind the holding space 14 and communicates with the rear end (terminal entrance opening 15) of the holding space 14. A cross-sectional shape of the guiding space 21 is substantially circular. The inner surface of the guiding space 21 is tapered to make a cross-sectional area gradually smaller toward the front (toward the holding space 14). The sealing space 22 is disposed behind the guiding space 21 and communicates with the rear end of the guiding space 21. The sealing space 22 constitutes a rear end area of the terminal accommodation chamber 13 and has a circular cross-sectional shape.

<Terminal Fitting 30>

Figure 7:
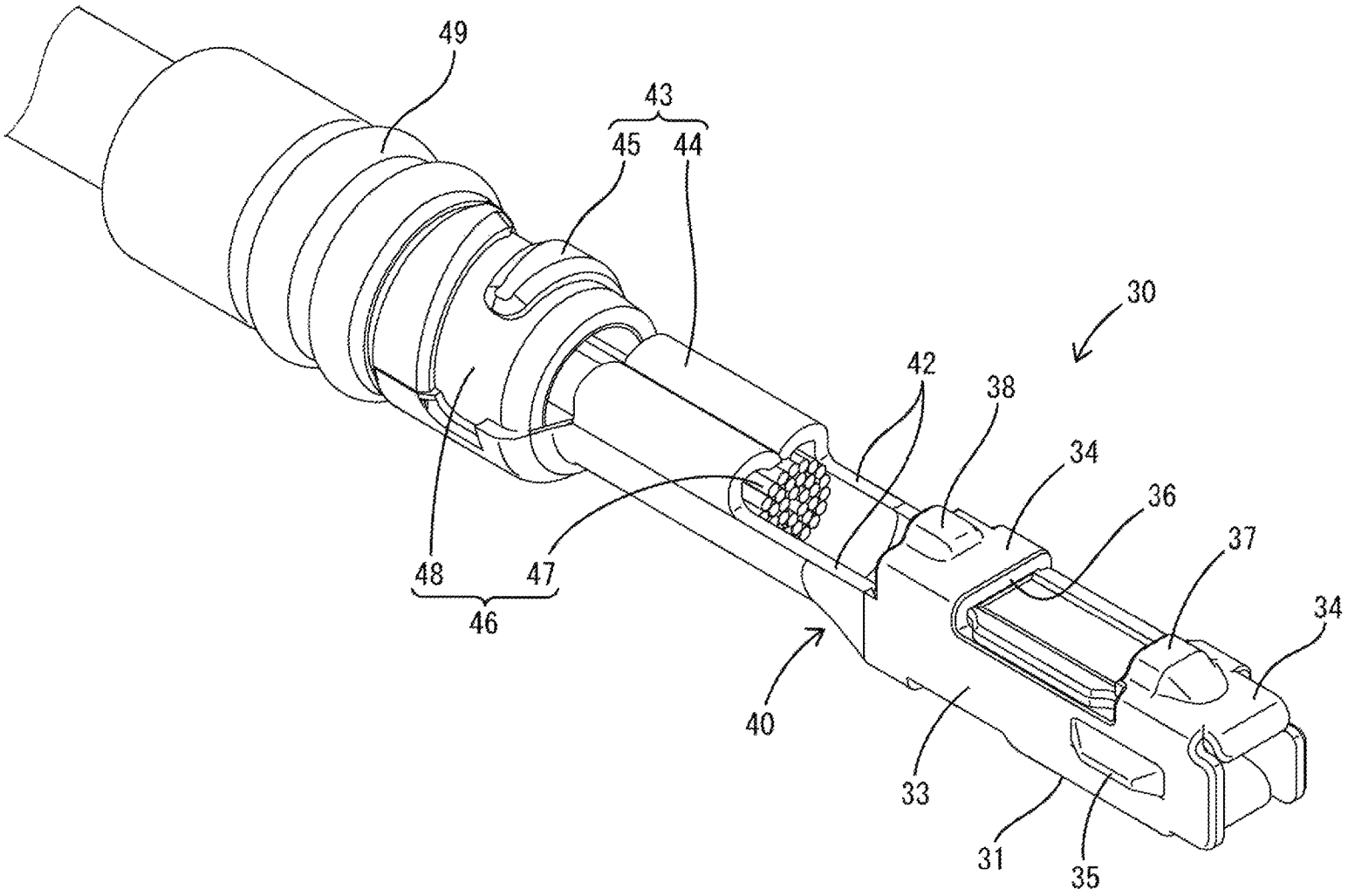
FIG. 7 is a perspective view of the terminal fitting.
Figure 8:
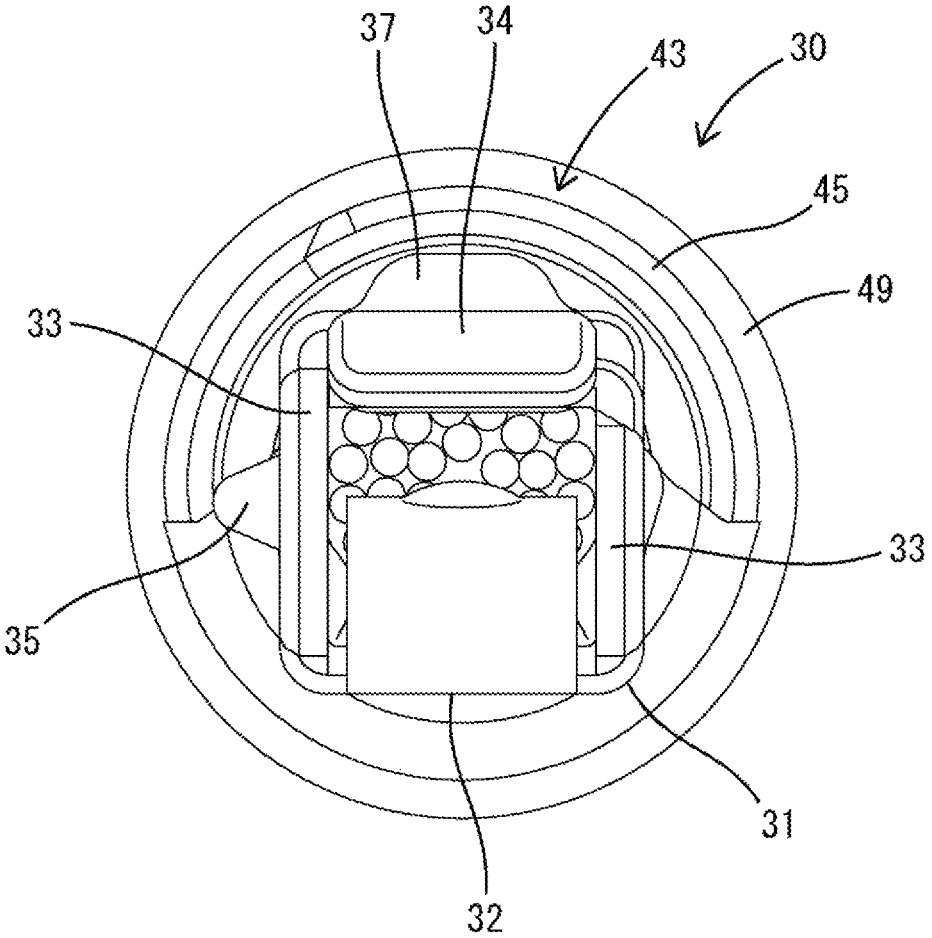
FIG. 8 is a front view of the terminal fitting.
Figure 9:
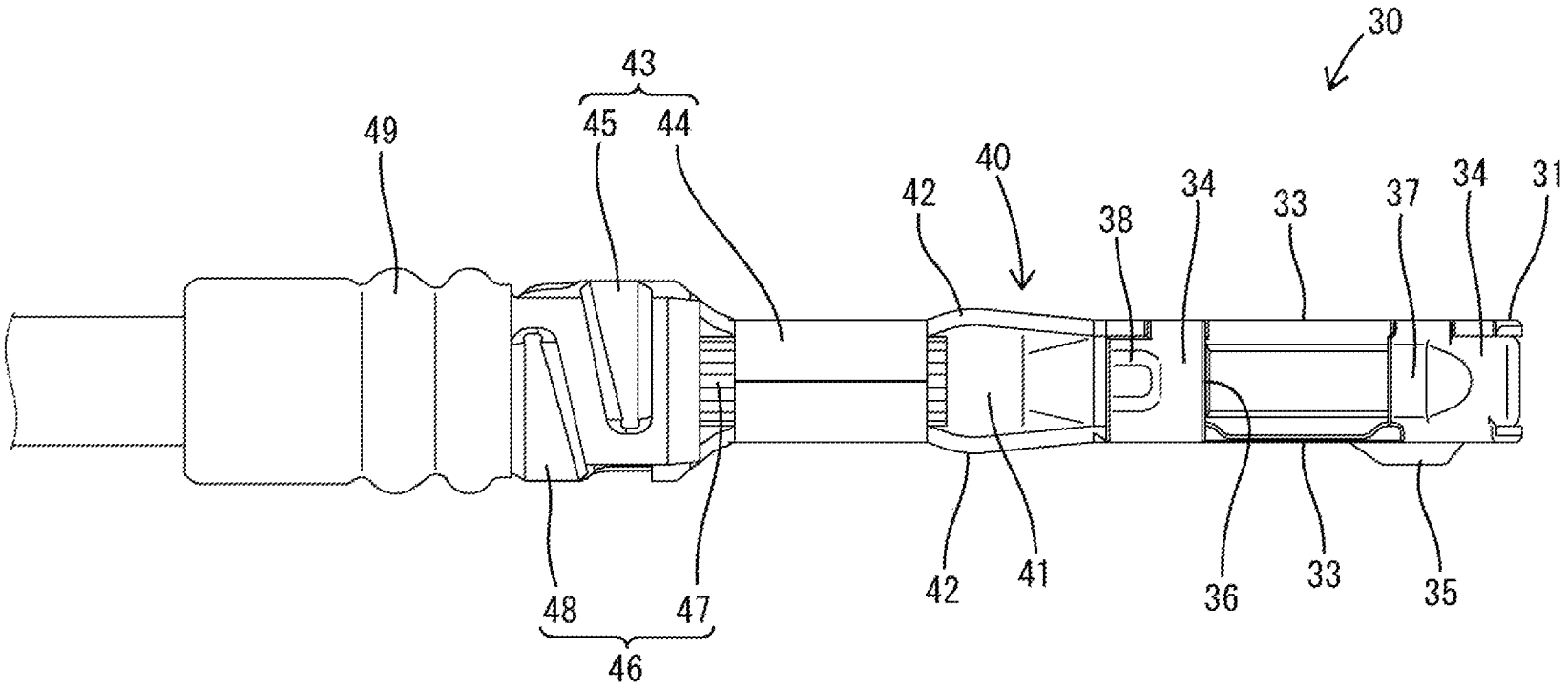
FIG. 9 is a plan view of the terminal fitting.

As shown in FIGS. 7 to 9, the terminal fitting 30 is a single member with a rectangular tubular terminal body 31 at a front end and a crimping portion 43 at a rear end for crimped connection to both a wire 46 and a rubber plug 49. The coupling 40 links the rear end of the terminal body 31 and the front end of the crimping portion 43.

The terminal body 31 has a base plate 32, left and right side plates 33 and a ceiling plate 34. The side plate 33 that is on the left side in an orientation where the base plate 32 is on a lower side in a front view of the terminal fitting 30 is formed with the stabilizer 35 in the form of a projection. The stabilizer 35 is near the front end of the terminal body 31. In an orientation where the base plate 32 is on the lower side, the stabilizer 35 is substantially at a center in the vertical direction of the side plate 33.

The ceiling plate 34 is formed with a locking hole 36, a locking projection 37 and a guide projection 38. The locking hole 36 is formed by partially cutting off the ceiling plate 34. The locking projection 37 is formed to bulge out by striking a front part of the locking hole 36 of the ceiling plate 34. The guide projection 38 is formed to bulge out by striking a rear part of the ceiling plate 34 behind the locking hole 36.

The coupling 40 includes a base plate 41 and left and right side plates 42 cantilevered in a circumferential direction from both left and right ends of the base plate 41. The front end of the base plate 41 of the coupling 40 is connected directly to the rear end of the base plate 32 of the terminal body 31. The front ends of the left and right side plates 42 are connected directly to the rear ends of the left and right side plates 33 of the terminal body 31.

In the front view of the terminal fitting 30, circumferential end parts of the left and right side plates 42 project farther out than outer side surfaces of the left and right side plates 33 of the terminal body 31. A maximum width of the coupling 40 (dimension between lateral ends of the left and right side plates 42) is larger than a width of the terminal body 31 (dimension between the outer side surfaces of the left and right side plates 33).

The crimping portion 43 is an open barrel that includes a wire barrel 44 directly connected to the rear end of the coupling 40 and an insulation barrel 45 connected to the rear end of the wire barrel 44. The wire barrel 44 is crimped and conductively fixed to an exposed part of a core 47 of the wire 46. The insulation barrel 45 is crimped and fixed to a part of the wire 46 surrounded by an insulation coating 48 and a front end part of the rubber plug 49 externally fit on the wire 46.

Figure 4:
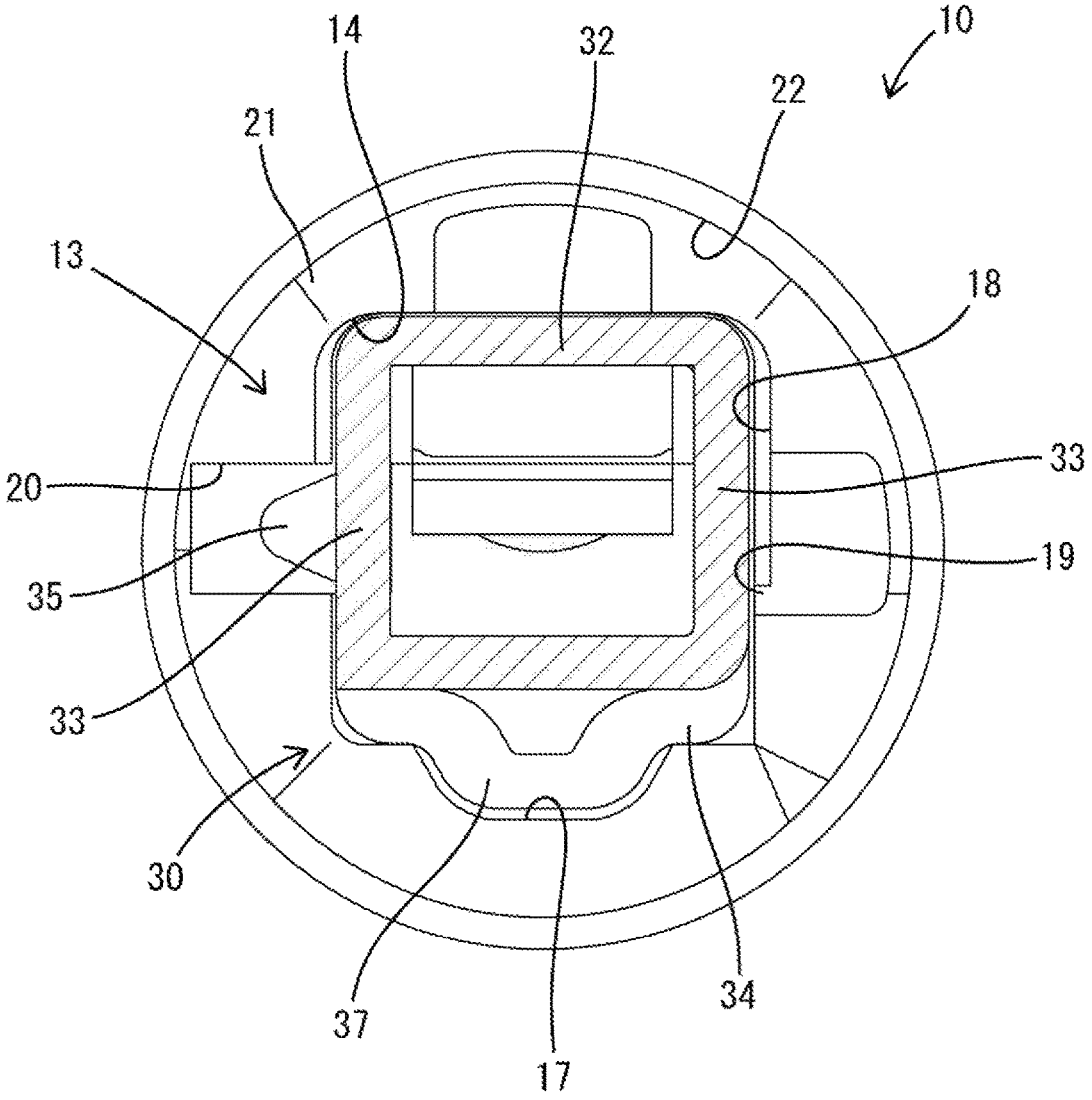
FIG. 4 is a back view showing a terminal fitting inserted in the terminal accommodation chamber in a proper posture and a stabilizer in a positioning groove.
Figure 5:
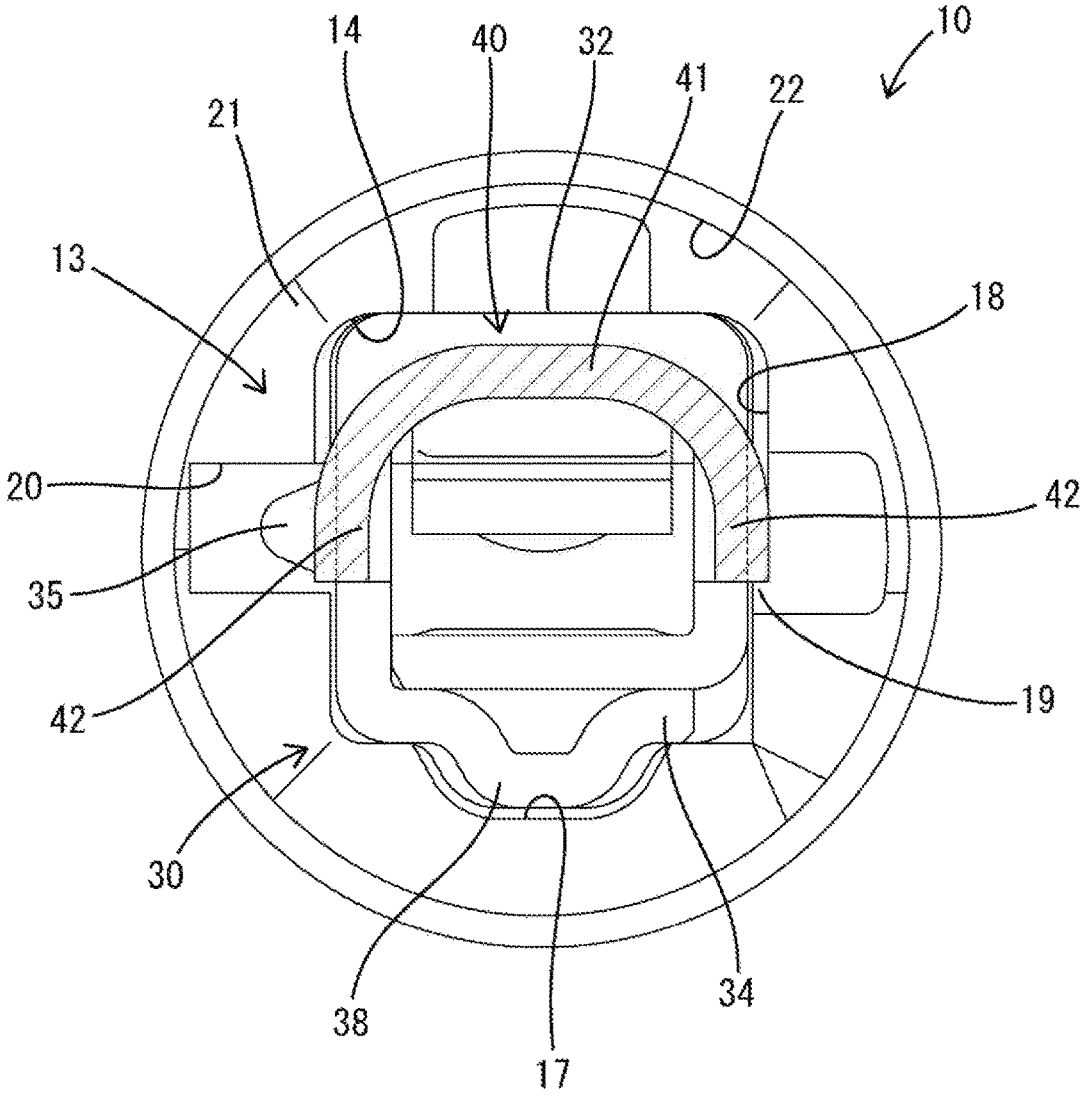
FIG. 5 is a back view showing a state where the terminal fitting is inserted in the proper posture in the terminal accommodation chamber and a coupling portion is accommodated in an escaping recess.

The terminal fitting 30 is inserted into the terminal accommodation chamber 13 from behind the housing 10. When the terminal fitting 30 is in a proper posture in the vertical and lateral directions with respect to the housing 10, the terminal fitting 30 is oriented to be inverted vertically from the orientation shown in FIGS. 7 and 8. At the start of inserting the terminal fitting 30 in the proper posture, the stabilizer 35 is accommodated into the positioning groove 20 and the locking projection 37 and the guide projection 38 are accommodated into the guide groove 17, as shown in FIGS. 4 and 5. Further, in the process of insertion, the locking lance 16 interferes with the terminal body 31 to be deflected resiliently down.

When the terminal fitting 30 is inserted to a proper position, the terminal body 31 and the coupling 40 are accommodated into the holding space 14. Then, the locking lance 16 resiliently returns to be locked to the locking hole 36 and the locking projection 37 from behind and to retain the terminal fitting 30. With the terminal fitting 30 properly inserted, circumferentially extending end parts of the side plates 42 of the coupling 40 (i.e. parts of the side plates 42 projecting laterally from the terminal body 31) are accommodated into the escaping recess 18 and the positioning groove 20. Further, the crimping portion 43 is accommodated into the sealing space 22 and the outer periphery of the rubber plug 49 is held in close contact with the inner peripheral surface of the sealing space 22 for liquid-tight sealing between the outer periphery of the wire 46 and the inner periphery of the terminal accommodation chamber 13.

Figure 6:
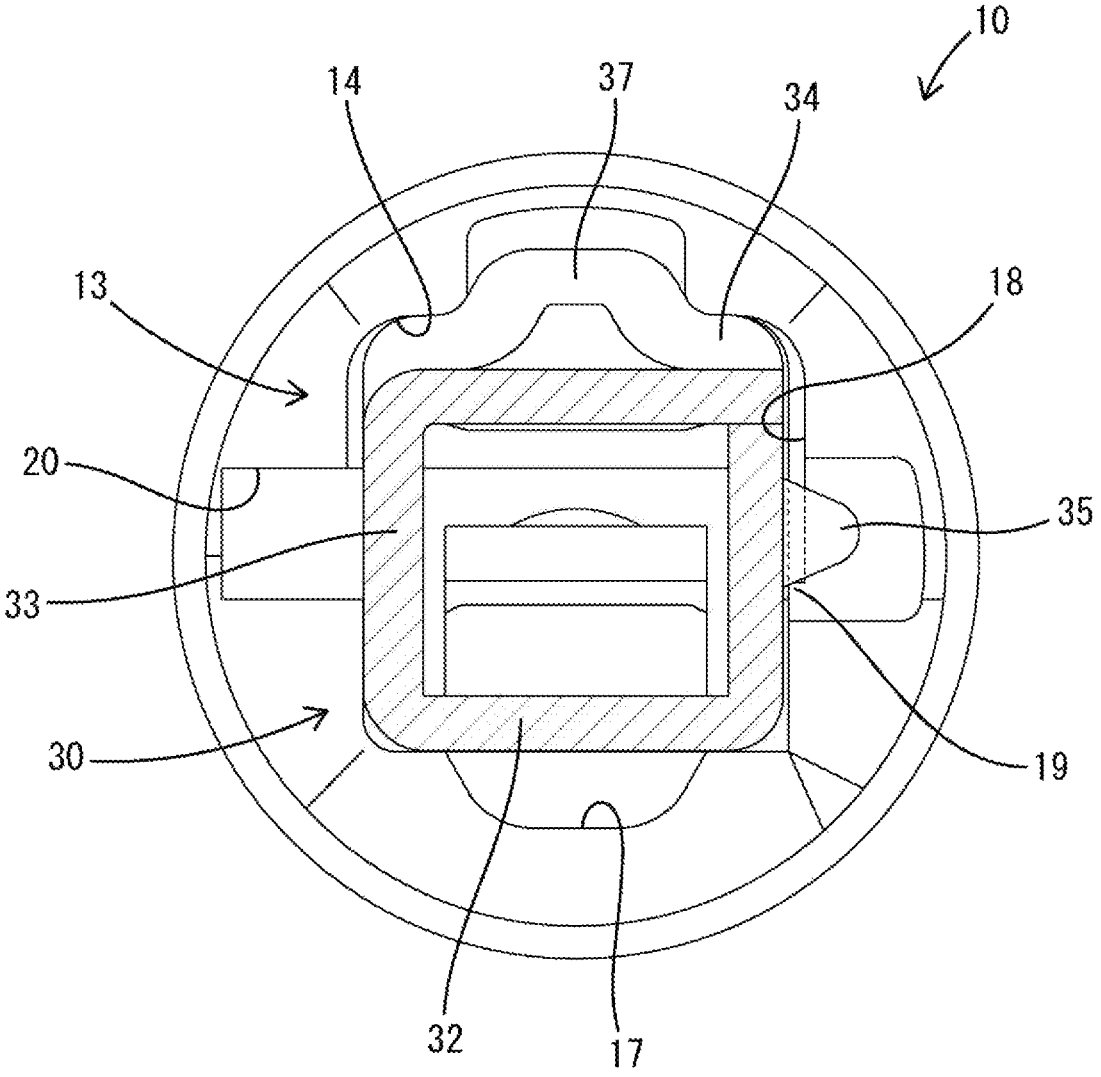
FIG. 6 is a back view showing a state where the terminal fitting starts being inserted in an improper posture into the terminal accommodation chamber and the stabilizer interferes with an interfering portion.

If the terminal fitting 30 is attempted to be inserted into the terminal accommodation chamber 13 in a vertically or laterally inverted improper posture, the stabilizer 35 is at a position to correspond to the escaping recess 18 and the locking projection 37 is on a side opposite to the guide groove 17 in the vertical direction in a back view, as shown in FIG. 6. A width (recessed dimension) of the escaping recess 18 is sufficiently smaller than a projecting dimension of the stabilizer 35. Thus, the stabilizer 35 cannot enter the escaping recess 18 and butts against the inner peripheral surface of the guiding space 21 (opening of the terminal entrance opening 15).

The locking projection 37 also butts against the inner peripheral surface of the guiding space 21 (opening edge of the terminal entrance opening 15) substantially when the stabilizer 35 butts against the inner peripheral surface of the guiding space 21. The stabilizer 35 and the locking projection 37 butt against each other to prevent farther insertion of the terminal fitting 30 into the holding space 14, thereby indicating that the terminal fitting 30 is in an improper posture and preventing insertion of the terminal fitting 30 into the terminal accommodation chamber 13 in the improper posture.

Further, an attempted insertion of an improperly oriented terminal fitting 30 into the terminal accommodation chamber 13 permits the terminal body 31 to starts entering the holding space 14, but causes the stabilizer 35 to contact the rear end of the interfering portion 19 of the escaping recess 18. Interference of the stabilizer 35 with the interfering portion 19 receives a reaction force obliquely acting toward a left-upper side in FIG. 6 from the interfering portion 19 and presses a front end part of the terminal body 31 against the upper surface and the left side surface (side surface with the positioning groove 20) of the holding space 14. A clearance between the ceiling plate 34 and the upper surface is eliminated in this way, and the locking projection 37 reliably butts against the opening edge of the terminal entrance opening 15 even if a vertical dimension of the terminal body 31 and a dimensional difference (tolerance) of the vertical dimension of the terminal body portion 31 are large.

As described above, the connector includes the housing 10 formed with the terminal accommodation chambers 13, the terminal fittings 30 to be inserted into the terminal accommodation chambers 13 from behind the housing 10, the stabilizers 35 projecting from the outer peripheral surfaces of the terminal fittings 30 and the interfering portions 19 formed on inner walls of the terminal accommodation chambers 13. If the terminal fitting 30 is inserted in an improper posture into the terminal accommodation chamber 13, the stabilizer 35 contacts the interfering portion 19. Thus, the terminal fitting 30 is pressed in a direction intersecting a projecting direction of the stabilizer 35 (up or obliquely up to the left in FIG. 6). Since a degree of interference of the terminal fitting 30 with the housing 10 increases in this way, the terminal fitting 30 reliably is prevented from being inserted into the terminal accommodation chamber 13 in an improper posture.

Further, the stabilizer 35 is at the position near the front end of the terminal fitting 30. Thus, whether or not the terminal fitting 30 is in an improper posture can be detected relatively early in the process of inserting the terminal fitting 30.

The rectangular tubular terminal body 31 is at the front part of the terminal fitting 30, the crimping portion 43 is at the rear part and the coupling 40 extends between the terminal body 31 and the crimping portion 43. The coupling 40 is wider than the terminal body 31. On the other hand, the escaping recess 18 for avoiding interference with the coupling 40 is formed in the inner wall of the terminal accommodation chamber 13, and the interfering portion 19 is formed in the escaping recess 18. According to this configuration, the shape of the inner wall of the terminal accommodation chamber 13 can be simplified as compared to the case where the interfering portion 19 is formed in a part different from the escaping recess 18.

The invention is not limited to the above described embodiment. For example, the following embodiments are also included in the scope of the invention.

Although the interfering portion is formed in the escaping recess in the above embodiment, the interfering portion may be formed elsewhere.

Although the escaping recess for avoiding interference with the coupling is formed in the terminal accommodation chamber in the above embodiment, the invention is also applicable to connectors in which an escaping recess is not formed in a terminal accommodation chamber.

Although the coupling between the terminal body and the crimping portion is wider than the terminal body in the above embodiment, the invention is also applicable in the case where the width of the coupling is equal to or smaller than that of the terminal body.

Although the stabilizer is near the front end of the terminal fitting in the above embodiment, the stabilizer may be disposed in a central part of the terminal body in the front-rear direction or in a rear end part of the terminal body.

Although the guiding space is connected behind and adjacent to the holding space of the terminal accommodation chamber in the above embodiment, the invention is also applicable to connectors in which no guiding space behind a holding space.

Although the waterproof connector is described in the above embodiment, the invention is also applicable to non-waterproof connectors.

LIST OF REFERENCE SIGNS

10 . . . housing
13 . . . terminal accommodation chamber
18 . . . escaping recess
19 . . . interfering portion
30 . . . terminal fitting
31 . . . terminal body
35 . . . stabilizer
40 . . . coupling
43 . . . crimping portion
46 . . . wire

What is claimed is:

1. A connector, comprising:

a housing formed with a terminal accommodation chamber;

a terminal fitting to be inserted into the terminal accommodation chamber from behind the housing;

a stabilizer defining a projection deformed to project out from an outer peripheral surface of the terminal fitting, the stabilizer tapering to narrower dimensions at farther distances out from the outer peripheral surface of the terminal fitting and being integral to the outer peripheral surface of terminal fitting around an entire periphery of the stabilizer; and an interfering portion formed on an inner wall of the terminal accommodation chamber;

the terminal fitting being pressed in a direction intersecting a projecting direction of the stabilizer by the stabilizer coming into contact with the interfering portion when the terminal fitting is inserted in an improper posture into the terminal accommodation chamber.

2. The connector of claim 1, wherein the stabilizer is disposed at a position near a front end of the terminal fitting.

3. The connector of claim 2, wherein:

the rectangular tubular terminal body is formed in a front part of the terminal fitting and a coupling is formed in a rear part of the terminal fitting, the coupling being crimped to a wire and being wider than the terminal body;

an escaping recess for avoiding interference with the coupling is formed in the second inner surface of the terminal accommodation chamber; and the interfering portion is adjacent the escaping recess.

4. A connector comprising:

a terminal fitting having a rectangular tubular terminal body at a front part of the terminal fitting and having first and second opposed side plates, a coupling at a rear part of the terminal fitting, the coupling being crimped to a wire and being wider than the terminal body so as to project laterally beyond the side plates of the body, a stabilizer projecting out from the first side plate of the terminal fitting farther than the coupling;

a housing formed with a terminal accommodation chamber for receiving the terminal fitting, the terminal accommodating chamber having first and second opposed inner side surfaces, a positioning groove formed in the first inner side surface and configured to receive the stabilizer when the terminal fitting is in a proper orientation, an escaping recess formed in the second inner surface of the terminal accommodation chamber; for receiving the coupling when the terminal fitting is in the proper orientation and an interfering portion formed on the second inner side surface adjacent the escaping recess, the interfering portion being disposed and configured to contact the stabilizer when the terminal fitting is inserted into the terminal accommodating chamber in an orientation inverted from the proper orientation and 3 shifting the terminal fitting in a direction intersecting a projecting direction of the stabilizer.

5. The connector of claim 4, wherein the stabilizer defines a deformed area of the first side plate and remains joined to the first side plate around an entire periphery of the stabilizer.

6. The connector of claim 5, wherein the stabilizer tapers at farther distances out from the first side plate.

7. A connector, comprising:

a housing formed with a terminal accommodation chamber having opposed first and second inner side surfaces, and opposed ceiling and base surfaces extending between the side surfaces, a positioning groove formed in the first side surface and a guide groove formed in the base surface, a locking lance projecting into the guide groove and an interfering portion formed on the second side surface of the terminal accommodating chamber;

a terminal fitting to be inserted into the terminal accommodation chamber from behind the housing, the terminal fitting having a rectangular tubular terminal body with opposed first and second side plates and opposed ceiling and base plates extending between the side plates; and a stabilizer projecting out from the first side plate of the terminal body and a locking projection projecting out from the base plate of the terminal body, wherein the terminal fitting is pressed in a direction intersecting a projecting direction of the stabilizer by the stabilizer coming into contact with the interfering portion when the terminal fitting is inserted in an improper posture into the terminal accommodation chamber.

8. The connector of claim 7, wherein the stabilizer defines a deformed area of the first side plate and remains joined to the first side plate around an entire periphery of the stabilizer.

9. The connector of claim 8, wherein the stabilizer tapers at farther distances out from the first side plate.

* * * * *